US005266026A

United States Patent [19]

Riehl

[11] Patent Number: 5,266,026

[45] Date of Patent: Nov. 30, 1993

[54] BURNER CONSTRUCTION AND METHOD OF MAKING THE SAME

[75] Inventor: Fred Riehl, Greensburg, Pa.

[73] Assignee: Robertshaw Controls Company, Richmond, Va.

[21] Appl. No.: 34,905

[22] Filed: Mar. 22, 1993

Related U.S. Application Data

[63] Continuation of Ser. No. 599,042, Oct. 17, 1990, abandoned.

[51] Int. Cl.[5] ..... F23Q 3/00

[52] U.S. Cl. ..... 431/264; 126/39 E; 431/258; 29/890.02; 239/552

[58] Field of Search ..... 431/264, 258, 266, 264; 126/39 E, 39 R, 39 N, 39 K; 29/890.02; 239/552, 567

[56] References Cited

U.S. PATENT DOCUMENTS

| | | | |
|---|---|---|---|
| 1,004,291 | 9/1911 | Merrill | 239/552 |
| 3,950,124 | 4/1976 | Berry | 431/264 X |
| 4,622,946 | 11/1986 | Harley et al. | 126/39 E |
| 4,626,196 | 12/1986 | Stohrer, Jr. | 431/264 |
| 4,846,671 | 7/1989 | Kwiatek | 431/266 |
| 5,002,038 | 3/1991 | Riehl | 126/39 R |

FOREIGN PATENT DOCUMENTS 2609158 7/1988 France .

*Primary Examiner*—Larry Jones

*Attorney, Agent, or Firm*—Candor, Candor & Tassone

[57] ABSTRACT

A burner construction and method of making the same are provided, the burner construction comprising a burner body having a chamber therein and having opposed ends one of which is open to the chamber and the other of which has structure for interconnecting a source of fuel to the chamber, and a removable cap closing the one end of the body, the burner construction having ports interconnecting the chamber to the exterior of the burner construction and through which the fuel can issue to burn externally to the burner construction, the burner construction comprising a removable venturi section disposed in the chamber and being removable therefrom through the open end of the body when the cap has been removed therefrom, the venturi section having an upper end temporarily fastened to a shoulder of the body by a fastening structure.

1 Claim, 7 Drawing Sheets

BURNER CONSTRUCTION AND METHOD OF MAKING THE SAME

CROSS-REFERENCE TO RELATED APPLICATION

This application is a continuation patent application of its copending parent patent application, Ser. No. 599,042, filed Oct. 17, 1990, now abandoned in favor of this continuation patent application.

BACKGROUND OF THE INVENTION

1. Field of the Invention

This invention relates to a new burner construction and to a new method of making such a burner construction.

2. Prior Art Statement

It is known to provide a burner construction comprising a burner body means having a chamber means therein and having opposed end means one of which is open to the chamber means and the other of which has means for interconnecting a source of fuel to the chamber means, the body means having a shoulder means extending into the chamber means, a removable cap means closing the one end means of the body means, the burner construction having port means interconnecting the chamber means to the exterior of the burner construction and through which the fuel can issue to burn externally to the burner construction, and a removable venturi section disposed in the chamber means so as to be removable therefrom through the open end means of the body means when the cap means has been removed therefrom and having opposed upper and lower open ends. For example, see the Merrill U.S. Pat. No. 1,004,291.

It is also known to provide a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, one of the body means and the cap means having an annular surface means interrupted by a plurality of radially disposed and spaced apart groove means whereby the annular surface means defines an annular land surface between each pair of adjacent groove means, the other of the body means and the cap means having an annular surface means cooperating with the annular surface means that has the groove means therein to close the groove means on one end thereof whereby the groove means define the port means. For example, see the aforementioned Merrill U.S. Pat. No. 1,004,291.

SUMMARY OF THE INVENTION

It is one feature of this invention to provide a new burner construction that has a unique means for maintaining a venturi section in the chamber means thereof.

In particular, it was found according to the teachings of the invention of applicant's copending patent application Ser. No. 448,935, filed Dec. 12, 1989, that the burner body of the burner construction can be so constructed and arranged that a removable venturi section can be disposed in the chamber means to be readily removable therefrom by merely removing a removable cap means from the burner body, the venturi section having an upper end resting on an annular shoulder means of the body means.

However, it was found according to the teachings of this invention that fastening means can be utilized to temporarily fasten the venturi section to the shoulder means.

For example, one embodiment of this invention provides a burner construction comprising a burner body means having chamber means therein and having opposed end means one of which is open to the chamber means and the other of which has means for interconnecting a source of fuel to the chamber means, the body means having a shoulder means extending into the chamber means, a removable cap means closing the one end means of the body means, the burner construction having port means interconnecting the chamber means to the exterior of the burner construction and through which the fuel can issue to burn externally to the burner construction, a removable venturi section disposed in the chamber means so as to be removable therefrom through the open end means of the body means when the cap means had been removed therefrom and having opposed upper and lower open ends, and means temporarily fastening the upper end of the venturi section to the shoulder means.

It is another feature of this invention to provide a burner construction wherein unique means are provided for providing for secondary air flow between adjacent sets of port means thereof.

In particular, it was found according to the teachings set forth in applicant's aforementioned copending patent application, Ser. No. 448,935, filed Dec. 12, 1989, that one of the body means and the cap means of the burner construction can have an annular surface means interrupted by a plurality of radially disposed and spaced apart groove means and the other of the body means and the cap means can have an annular surface means cooperating with the annular surface means that has the groove means therein to close the groove means on one end thereof whereby the groove means define the port means of the burner construction.

However, it was found according to the teachings of this invention that certain of the lands defined by the annular surface means that has the groove means therein can each be spaced from the annular surface means of the other of the body means and the cap means to define a narrow flame crossover port means between its adjacent sets of groove means so that secondary air can flow between those sets of port means.

For example, another embodiment of this invention provides a burner construction comprising a burner body means having a chamber means therein and having opposed end means one of which is open to the chamber means and the other of which has means for interconnecting a source of fuel to the chamber means, and a removable cap means closing the one end means of the body means, the burner construction having port means interconnecting the chamber means to the exterior of the burner construction and through which the fuel can issue to burn externally to the burner construction, one of the body means and the cap means having an annular surface means interrupted by a plurality of radially disposed and spaced apart groove means whereby the annular surface means defines an annular land surface between each pair of adjacent groove means, the other of the body means and the cap means having an annular surface means cooperating with the annular surface means that has the groove means therein to close the groove means on one end thereof whereby the groove means define the port means, certain of the land surfaces being spaced from the annular surface means of the other of the body means and the cap means and the remainder of the land surfaces being engaged by the annular surface means of the other of the body means and the cap means whereby each certain land surface cooperates with the annular surface means of the other of the body means and the cap means to define a flame crossover port means between its adjacent pair of groove means.

Accordingly, it is an object of this invention to provide a new burner construction having one or more of the novel features of this invention as set forth above or hereinafter shown or described.

Another object of this invention is to provide a new method of making such a burner construction, the method of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
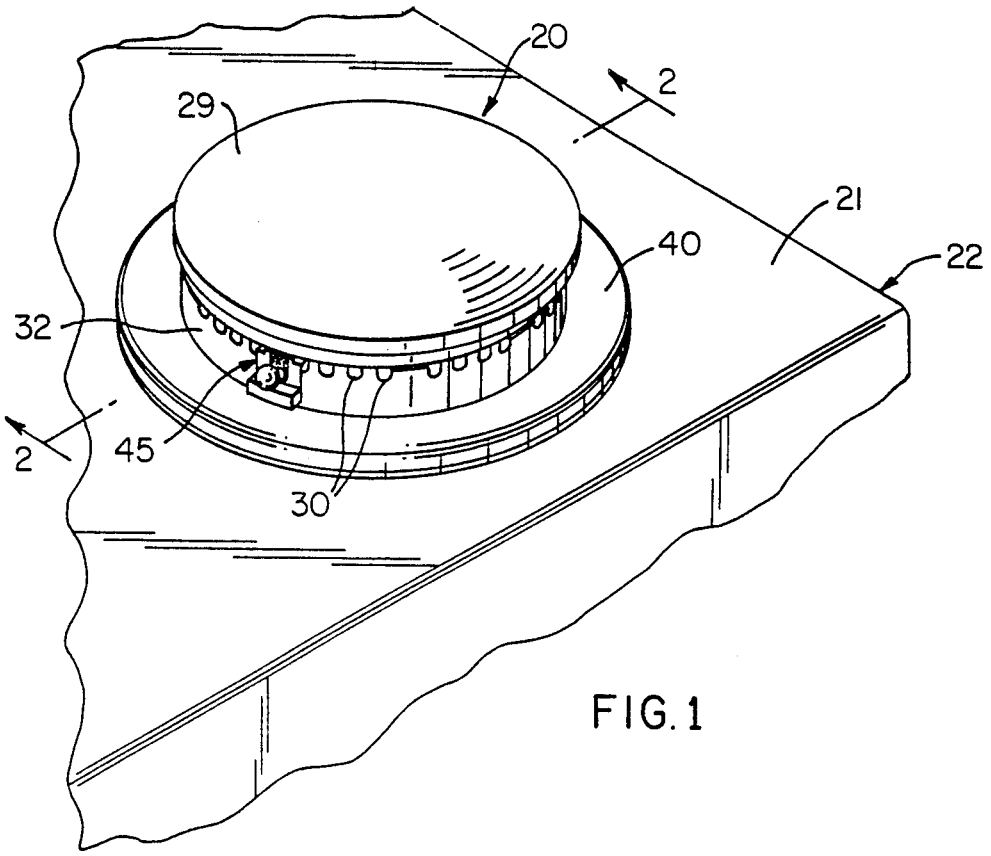
FIG. 1 is a fragmentary top view illustrating the new burner construction of this invention mounted in a range top of a cooking apparatus.

While the various features of this invention are hereinafter illustrated and described as being particularly adapted to provide a burner construction for being sealed into the range top of a cooking apparatus, it is to be understood that the various features of this invention can be utilized singly or in various combinations thereof to provide a burner construction for other apparatus as desired.

Therefore, this invention is not to be limited to only the embodiments illustrated in the drawings, because the drawings are merely utilized to illustrate one of the wide variety of uses of this invention.

Figure 2:
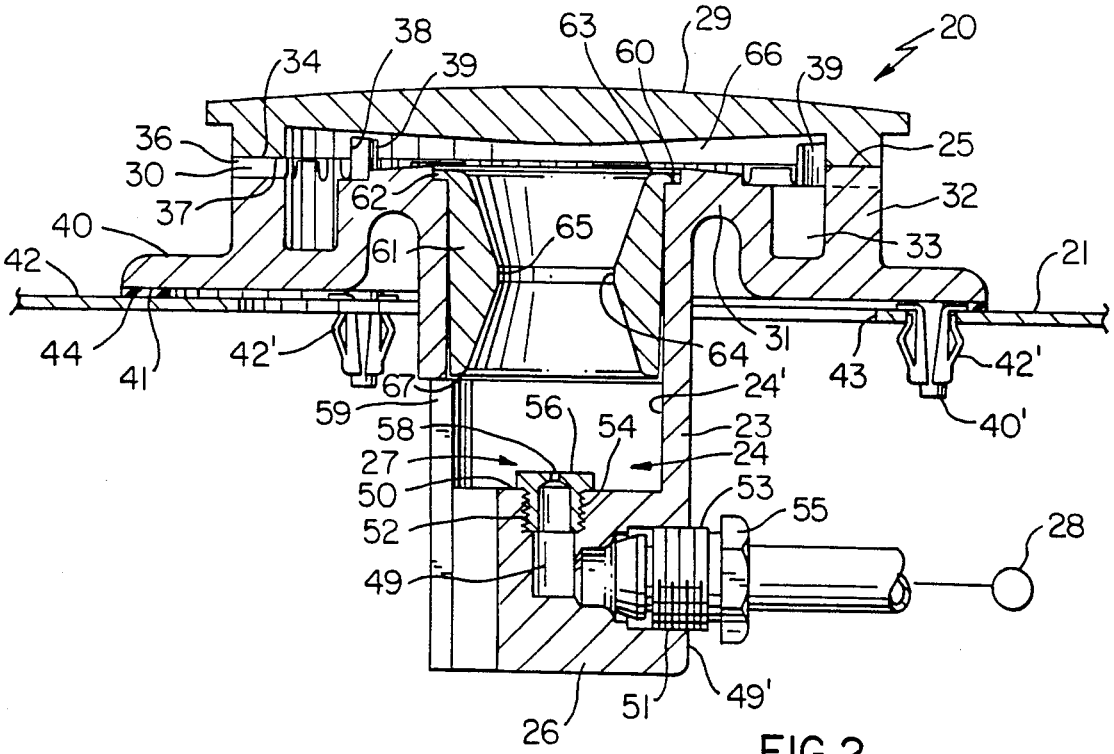
FIG. 2 is an enlarged fragmentary cross-sectional taken on line 2—2 of FIG. 1.

Referring now to FIGS. 1 and 2, the new burner construction of this invention is generally indicated by the reference numeral 20 and is illustrated as being sealed to a range top surface 21 of a cooking apparatus that is generally indicated by the reference numeral 22, the burner construction 20 comprising a burner body means 23 having a chamber means 24 therein and having opposed end means 25 and 26 with the end means 25 being open to the chamber means 24 and the other end means 26 being closed and having means that is generally indicated by the reference numeral 27 for interconnecting a source 28 of fuel with the chamber means 24 in a manner hereinafter set forth.

The burner construction 20 comprises a removable cap means 29 closing the open end means 25 of the body means 23, the burner construction 20 having a plurality of port means 30 interconnecting the chamber means 24 to the exterior of the burner construction 20 and through which fuel can issue to burn externally to the burner construction 20 in a manner well known in the art. For example, see the aforementioned Merrill U.S. Pat. No. 1,004,291, and the Kwiatek U.S. Pat. No. 4,846,671, whereby these two patents are being incorporated into this disclosure by this reference thereto.

While the body means 23 and cap means 29 of the burner construction 20 can be formed of any suitable material or combinations of materials, such as metallic materials, one working embodiment thereof has the body means 23 and cap means 29 each formed of die cast aluminum RMS-105 with the body means 23 being a one-piece member and with the open end means 25 thereof being defined by a first annular portion 31 surrounded by a second annular portion 32 disposed substantially concentrically therewith and spaced therefrom by an annular groove means 33 as illustrated.

Figure 4:
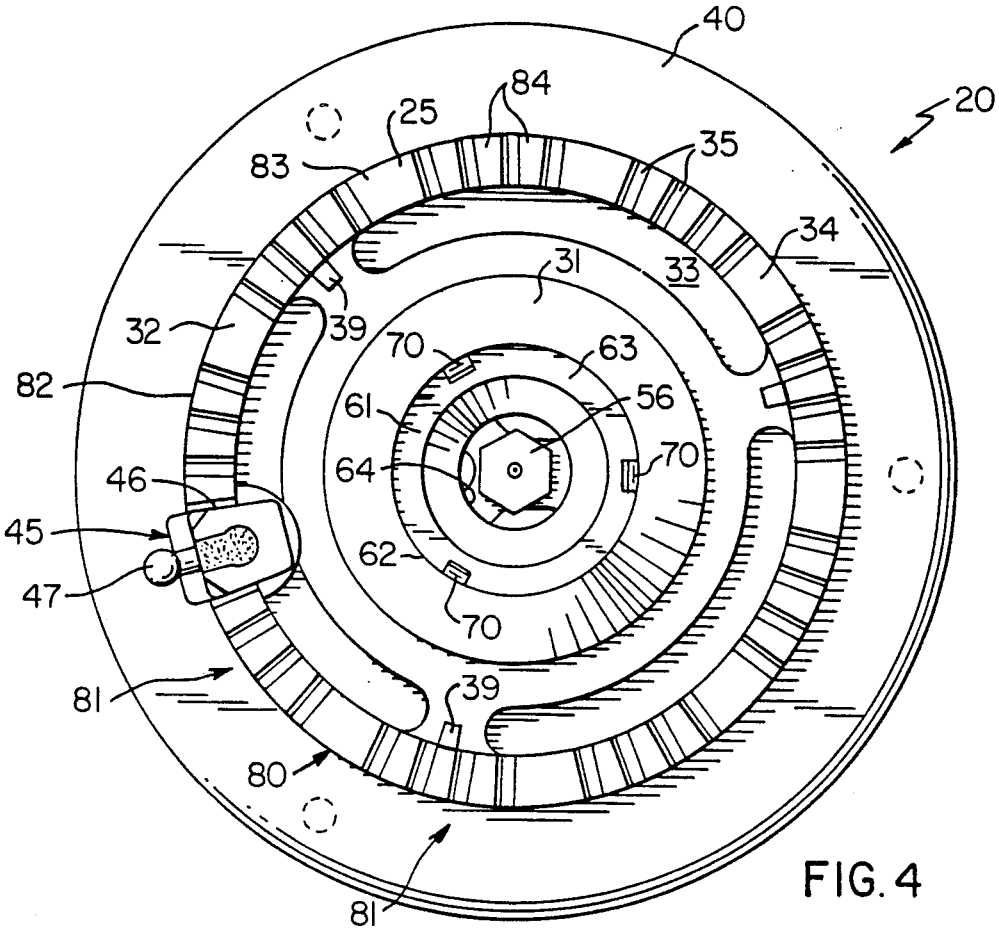
FIG. 4 is a top view of the burner construction of FIG. 3 with the cap means thereof removed so that FIG. 4 is taken substantially on line 4—4 of FIG. 3.

The outer annular portion 32 of the body means 23 has an annular substantially flat top surface means 34 interrupted by a plurality of radially disposed and spaced apart U-shaped grooves 35 disposed in the patterned circular array as illustrated in FIG. 4 and being adapted to be respectively closed at the open ends 36 thereof by a substantially flat annular surface 37 on the cap means 29 in the manner illustrated in FIG. 2 to form the port means 30 previously set forth, the annular surface 37 of the cap means 29 having a plurality of notches 38 formed therein to respectively receive locating projections 39 on the annular surface 34 of the body means 23 in the manner illustrated in FIG. 2 so as to orient the cap means 29 relative thereto and prevent the cap means 29 from slipping off the body means 23 when the same has been assembled thereto in the manner illustrated in FIGS. 1 and 2.

The body member 23 has an outwardly directed annular flange 40 provided with a substantially flat annular surface means 41 for facing the range top surface 21 of a range top structure 42 that has an opening 43 passing therethrough and in which the body member 23 projects as illustrated in FIG. 2 so as to be suspended in the opening 43 by the surface means 41 engaging against the range top surface 21.

The annular flange 40 is adapted to be sealed to the range top surface 21 by an annular sealing member 44 that forms part of the surface means 41 thereof in the manner illustrated in FIGS. 2 and 4, the annular flange 40 being secured to the range top structure 42 in any suitable and/or conventional manner, such as by having projections 40' on the flange 40 snap-fitting into suitable spring clip means 42' carried by the range top structure 42.

If desired, the annular flange 40 of the body means 23 can be provided with suitable opening means passing therethrough and receiving an electrode assembly for sparking from an electrode thereof to the burner construction 20 and thereby igniting fuel issuing out of the port means 30 adjacent thereto in a manner well known in the art whereby a further discussion of the details and the operation of an electrode assembly need not be set forth. For example, see applicant's copending patent application, Ser. No. 448,935, filed Dec. 12, 1989, and, since this application is now allowed, this application is being incorporated into this disclosure by this reference thereto.

However, it is preferred that an electrode assembly 45 be carried in an opening 46 of the body member 23 so that sparking from an electrode 47 thereof to burner construction 20 will ignite fuel issuing out of the port means 30 thereof, such unique electrode means 45 being fully disclosed in applicant's copending application, Ser. No. 508,799, filed Apr. 12, 1990. The means 27 for interconnecting the source 28 of fuel to the chamber means 24 of the burner body means 23 comprises a passage means 49 formed through the closed end means 26 of the burner body means 23 with the passage means 49 interrupting an external side surface 49' of the end means 26 as well as a substantially flat interior end wall means 50 of the end means 26, the passage means 49 being internally threaded at 51 and 52 respectively at the opposed ends thereof and respectively being adapted to receive threaded portions 53 and 54 of members 55 and 56.

The member 55 comprises a conduit coupling member or means which couples a conduit means 57 that leads from the source 28 of fuel to the passage means 49 and the member 56 comprising an input orifice member having an orifice 58 for controlling the amount of fuel being permitted to enter the chamber means 24 as is well known in the art.

It is to be understood that the conduit means 57 has suitable and conventional control means (not shown) therein for connecting and disconnecting the source 28 of fuel to and from the passage means 49 in a manner well known in range top art.

Figure 5:
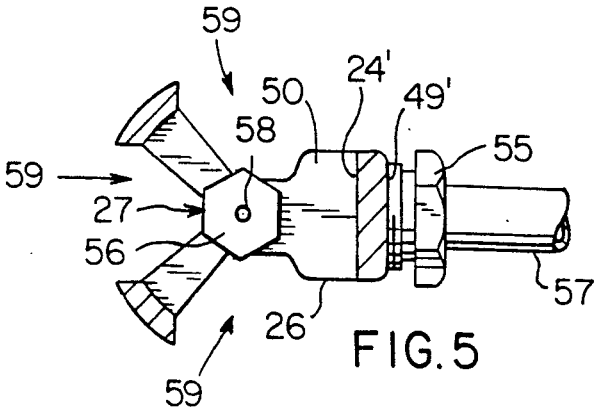
FIG. 5 is a fragmentary cross-sectional view taken on line 5—5 of FIG. 3.
Figure 7:
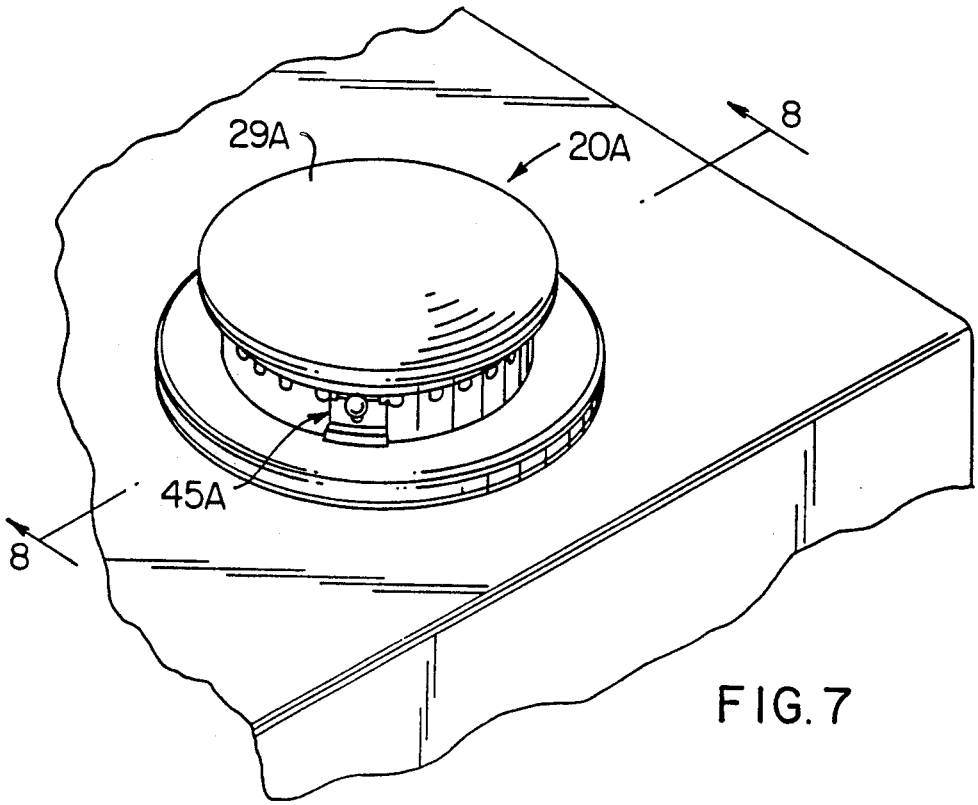
FIG. 7 is a view similar to FIG. 1 and illustrates another burner construction of this invention mounted in a range top of a cooking apparatus.

The burner body means 23 has a plurality of openings 59 formed therethrough that define air supply openings leading from the exterior of the body means to the chamber means 24 thereof that defines a cylindrical portion 24' of the chamber 24 adjacent the wall 50 that is formed into a spider portion by the openings 59 as illustrated in FIG. 5.

The burner body means 23 has an annular shoulder means 60 disposed in spaced parallel relation above the wall 50 and interrupting the annular portion 31 of the open end 25 thereof, the annular shoulder 60 being in aligned relation with the annular chamber portion 24' and having a greater diameter for a purpose hereinafter set forth.

A removable venturi section 61 of this invention is adapted to be disposed in the chamber means 24 through the open end means 25 thereof when the cap means 29 is removed from the body means 23, the venturi section 61 having an outwardly directed annular end flange 62 at the upper end 63 thereof and an hourglass-shaped intermediate portion 64 that provides a venturi throat 65 through which fuel must flow from the orifice member 56 to the open end 25 of the burner body 23 and into the space 66 disposed between the portion 31 of the end means 25 of the burner body 23 and the end cap 29 so as to flow to the ports 30 and issue out of the same as is readily apparent when viewing the burner construction 20 of this invention in FIG. 2.

The lower end 67 of the venturi section 61 has a diameter that permits the same to pass downwardly through the cylindrical portion 24' of the chamber means 24 as illustrated in FIG. 2 while the annular flange 62 at the upper end 63 of the venturi section 61 has a diameter that is too great to be received in the cylindrical portion 24' of the chamber means 24 but is adapted to rest on the annular shoulder 60 as illustrated in FIG. 2.

In this manner the venturi section 61 can only be disposed in the chamber means 24 of the burner body means 23 with the end means 67 thereof being first inserted into the chamber means 24 as the end means 63 cannot be first inserted into the chamber means 24 through the oversize of the flange 62 thereof relative to the cylindrical portion 24' of the chamber means 24. This, of course, insures proper insertion of the venturi section 61 either during initial assembly of the burner construction 20 or during subsequent removal and replacement of the same or different venturi section 61 as the case may be.

The openings 59 in the burner body 23 provide primary air that is adapted to be drawn into the chamber means 24 of the burner body means 23 to mix with the fuel issuing out of the orifice 58 of the orifice member 56 before the same enters the lower end 67 of the venturi section 61.

It was found according to the teachings of this invention that since the diameter of the throat 65 of the venturi section 61 is large enough to permit a suitable tool to be inserted through the venturi section 61 to remove the orifice member 56 and replace the same with another orifice member 56 without removing the venturi section 61 from the burner body means 23 after the cap means 29 has been removed in the manner illustrated in FIG. 4, means could be provided for temporarily fastening the venturi section 61 in its assembled relation with the burner body means 23.

In particular, it was found according to the teachings of this invention that the annular portion 31 of the burner body means 23 could be staked over the flange 62 at the upper end 63 of the venturi section 21 to hold the flange 62 against the shoulder means 60 and such staking is indicated by the reference numeral 70 in FIG. 4 wherein three such stakings 70 are illustrated and are disposed in a circular array in equally spaced apart relation.

However, should it be desired to change the staked venturi section 61, the staking 70 can be readily broken away and the venturi section 61 can then be removed through the open end 25 of the burner body 23 and a new venturi section 61 could then be disposed in place and new portions of the annular flange 31 subsequently staked over the flange 62 thereof to temporarily fasten that venturi section 61 in place.

Of course, other fastening means could be utilized to temporarily fasten the venturi section in place, if desired.

For example, another fastening means of this invention is generally indicated by the reference numeral 71 in FIGS. 7–12 wherein another burner construction of this invention is generally indicated by the reference numeral 20A and parts thereof similar to the burner construction 20 previously described are indicated by like reference numerals followed by the reference letter "A".

Figure 8:
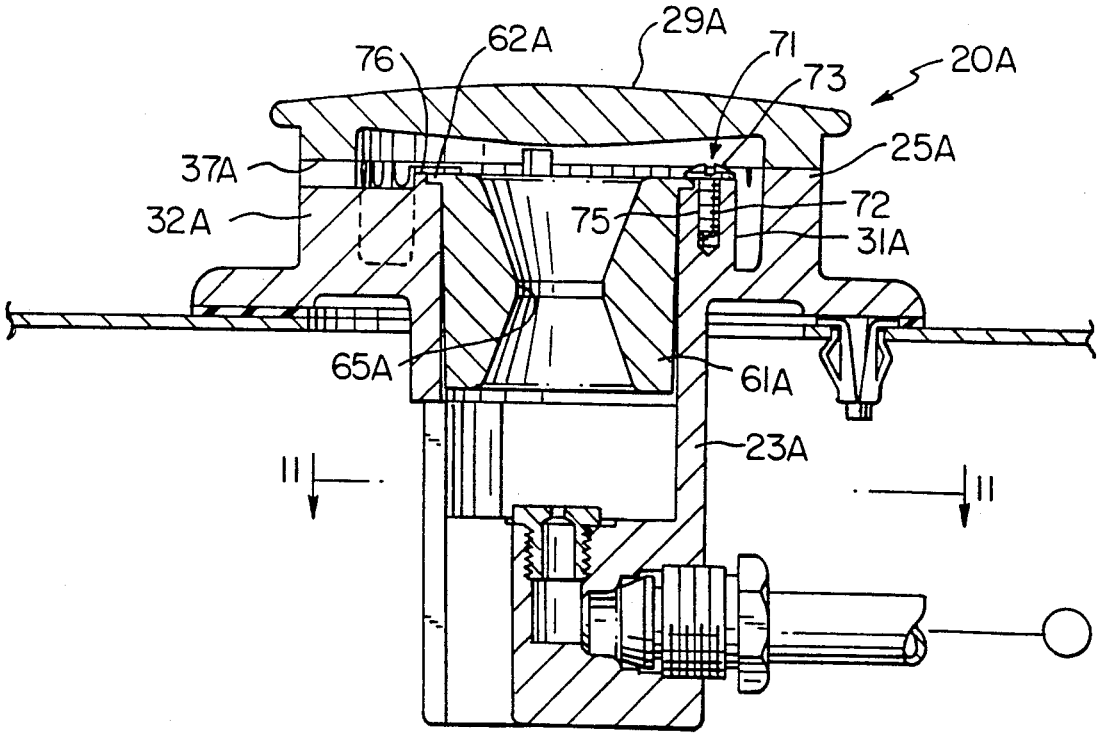
FIG. 8 is a fragmentary cross-sectional view taken on line 8—8 of FIG. 7.
Figure 10:
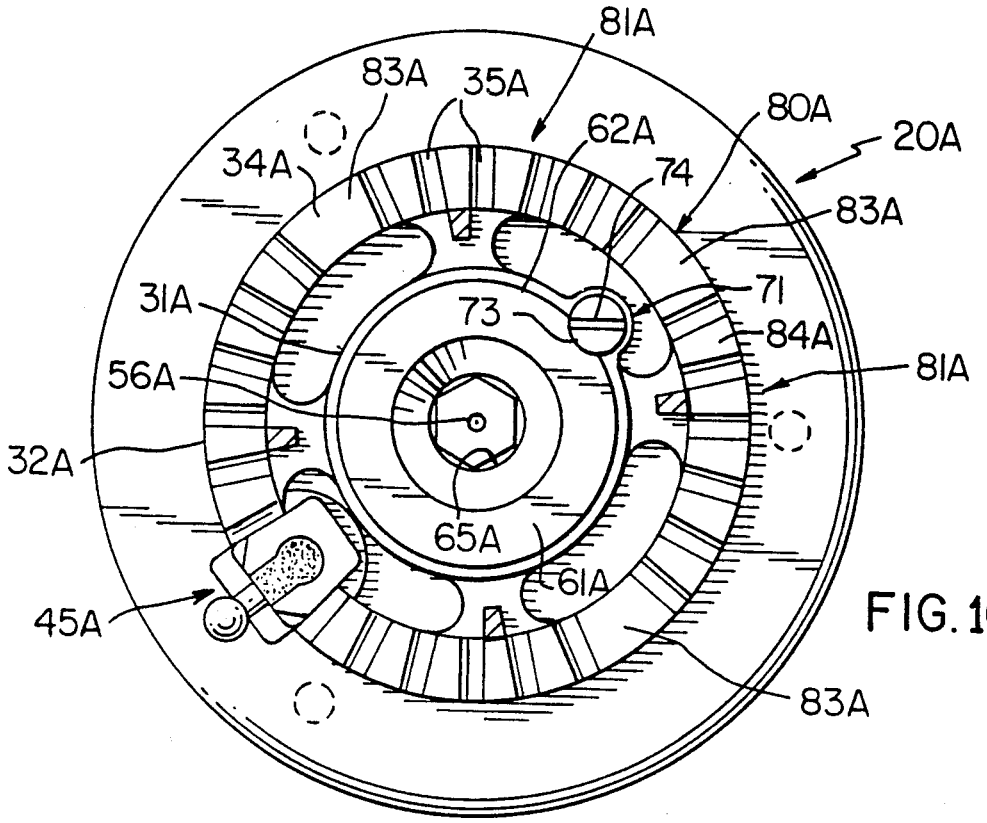
FIG. 10 is a top view of the burner construction of FIG. 9 with the cap means thereof removed so that FIG. 10 is taken substantially on line 10—10 of FIG. 9.
Figure 9:
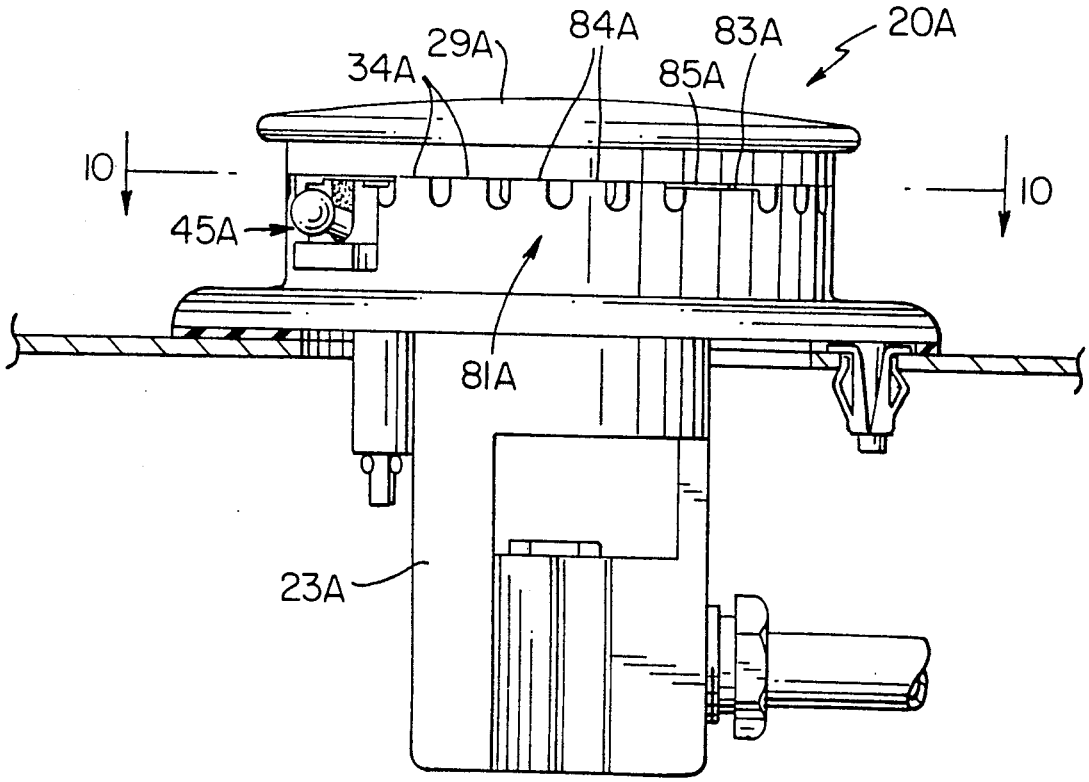
FIG. 9 is a view similar to FIG. 8 except that the burner construction is shown in elevation.
Figure 12:
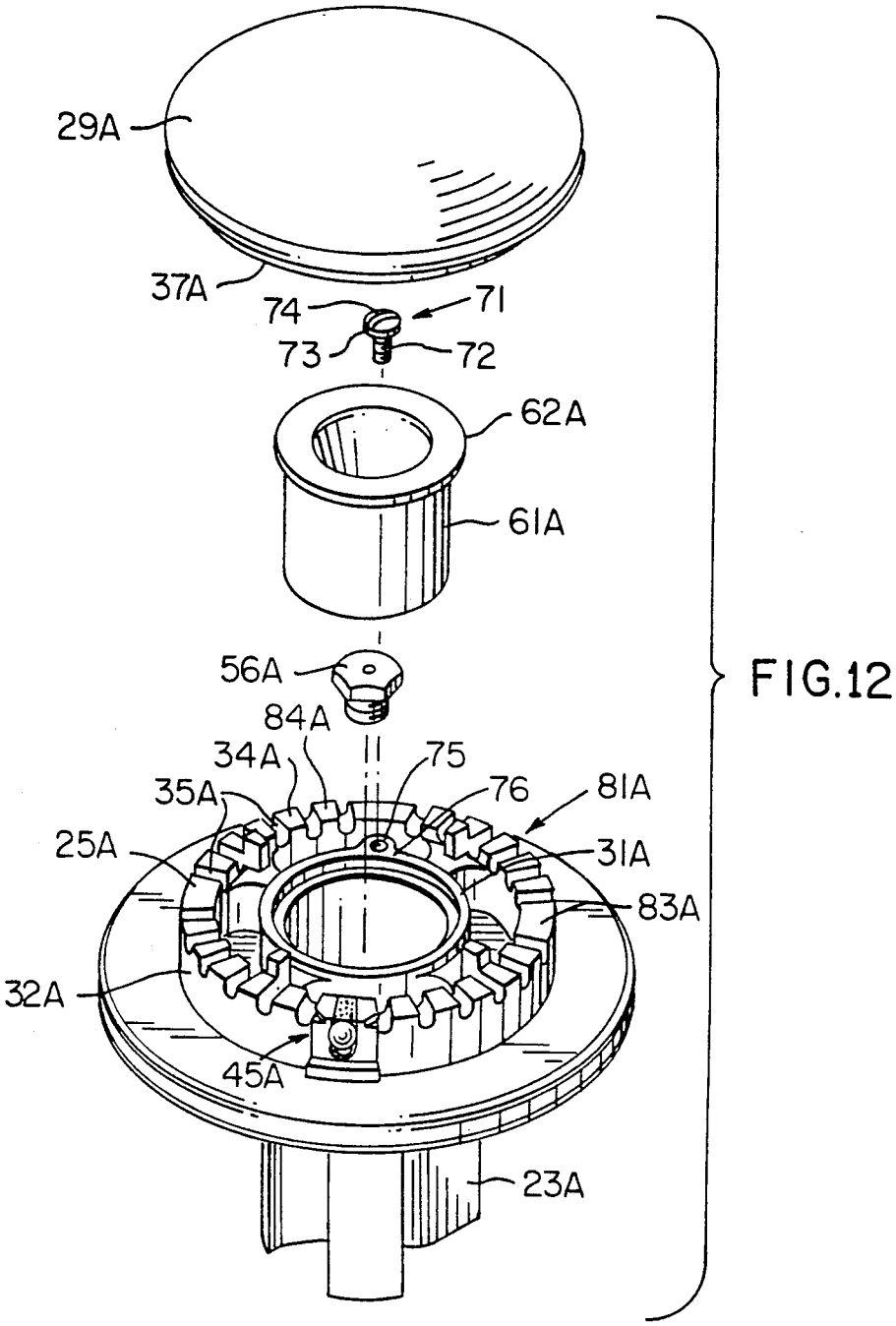
FIG. 12 is an exploded perspective view of various parts of the burner construction of FIGS. 7-11.
Figure 11:
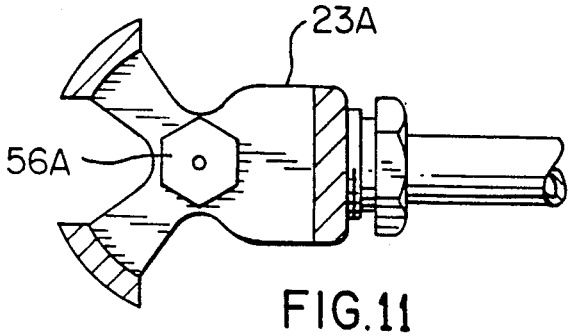
FIG. 11 is a fragmentary cross-sectional view taken on line 11—11 of FIG. 8.

As illustrated in FIGS. 7–12, the fastening means 71 is a threaded fastening member having a threaded shank portion 72 and an enlarged head 73 provided with the conventional slot 74 therein for utilizing a suitable tool, such as a screwdriver or the like, to thread the shank portion 72 into and out of an internally threaded opening 75 in the burner body 23A so that the enlarged head 73 of the fastening member 71 will overlap a substantially flat surface 76 of the annular portion 31A of the burner body 23A and the flange 62A of the venturi section 61A in the manner illustrated in FIGS. 8 and 10 to hold the venturi section 61A in place.

In this manner, it can be seen that it is relatively easy to change the venturi section 61A of the burner construction 20A by merely opening the cap means 29A and utilizing a screwdriver to remove the fastening means 71 so that once the fastening means 71 has been removed, the venturi section 61A can be removed out through the open end means 25A of the burner body 23A and a new venturi section 61A can be disposed in place and be temporarily fastened therein by the replaced fastening member 71 or a new fastening member 71 in the manner previously set forth.

Thus, it can be seen that the fastening means 71 of this invention is more adaptable to being utilized with a venturi section 61A that has a relatively small diameter for the throat area 65A thereof wherein it would be relatively difficult or impossible to remove the orifice means 56A through the throat 65A of the venturi section 61A in the manner previously described for the venturi section 61 of the burner construction 20.

However, it is to be understood that even with a narrow throat venturi section 61A, the stake fastening means 70 of the burner construction 20 can be utilized therewith rather than the fastening means 71, if desired. And, of course, even with a large throat venturi section 61, the fastening means 71 could be used instead of the stake fastening means 70, if desired.

Accordingly, once the venturi section 61 or 61A has been removed, then the orifice member 56 or 56A can then be readily removed through the open end means 25 or 25A of the burner body 23 or 23A.

As previously stated, it is another feature of this invention to provide a unique port arrangement in the burner constructions 20 and 20A of this invention and it is to be understood that while the grooves 35 and 35A are illustrated as being formed respectively in the annular surfaces 34 and 34A of the burner bodies 23 and 23A, such grooves could be provided in the annular surfaces 37 and 37A of the cap means 29 and 29A while the annular surfaces 34 and 34A of the burner bodies 23 and 23A would remain ungrooved, if desired.

Figure 3:
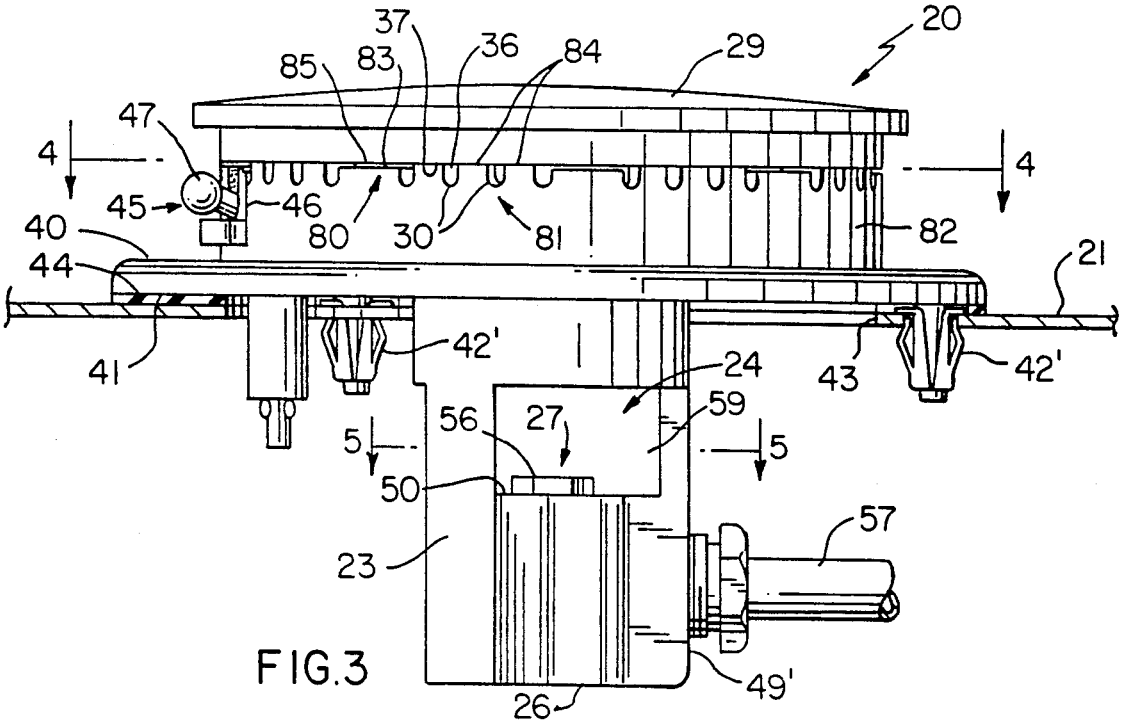
FIG. 3 is a view similar to FIG. 2 but showing the burner construction in elevation.
Figure 6:
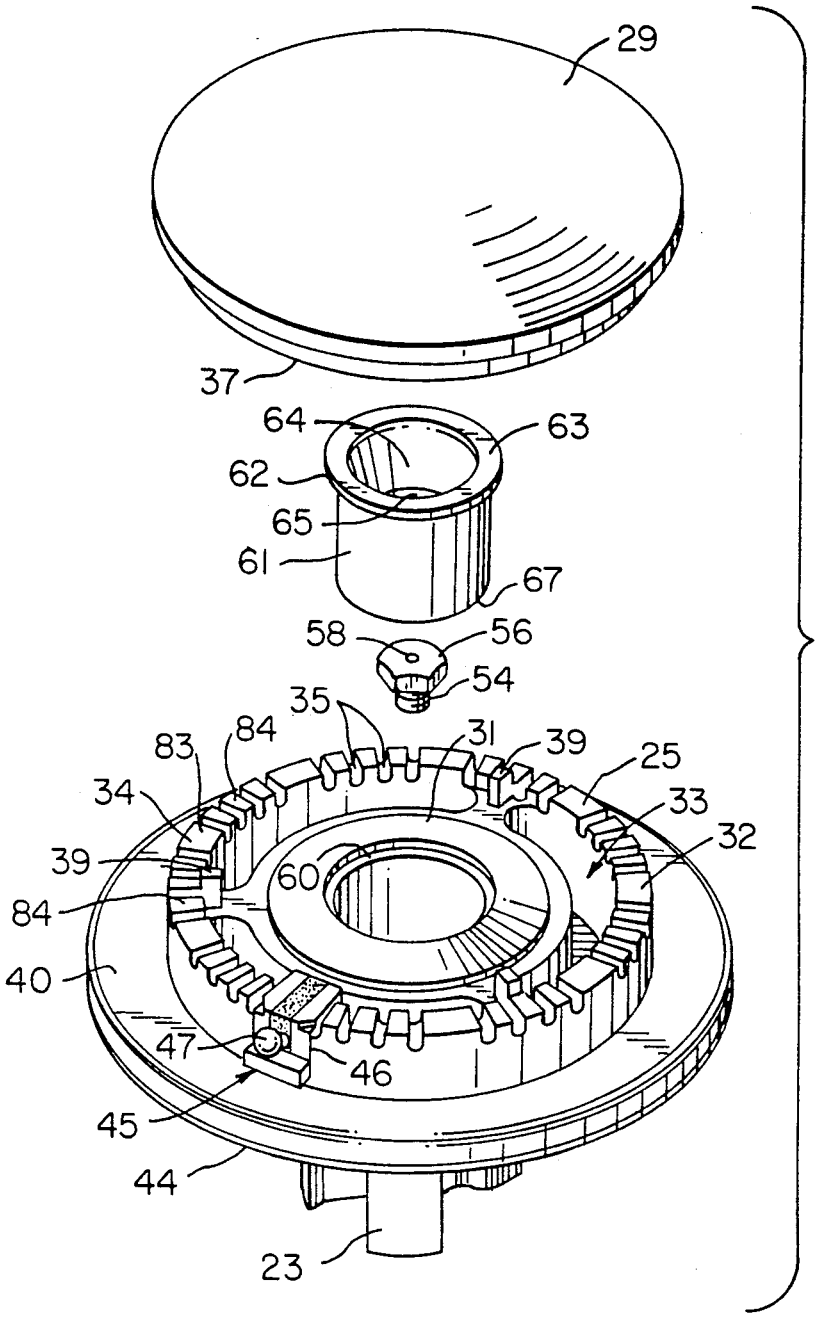
FIG. 6 is an exploded perspective view of various parts of the burner construction of FIGS. 1-5.

In any event, it was found according to the teachings of the invention set forth in applicant's aforementioned copending patent application, Ser. No. 508,799, filed Apr. 12, 1990, that in order to provide additional secondary air to the port means 30 of the burner construction 20, the port means 30 should be so patterned in the circular array thereof that relatively large unported areas 80 should be provided between ported areas 81 through the circumferential wall means 82 of the burner body means 23 as illustrated in FIGS. 1 and 3.

It was found that such patterned arrangement can be provided by having the annular surface 34 of the body means 23 provided with relatively large annular land surfaces 83 between the ported areas 81 which have relatively small annular land areas 84 between each pair of adjacent grooves 35 thereof. Thus, secondary air can be drawn into the unported areas 80 to supply the ported areas 81 with that secondary air for good combustion of the fuel issuing from the ports 30.

Also, it was found that in order to insure flame ignition crossover from the ports 30 that are disposed on opposite sides of the unported sections 80 of the burner construction 20, the large land surfaces 83 are each disposed spaced from the annular surface 37 of the cap means 29 a certain distance to provide for a carry-over flame at the resulting narrow gap 85 between that large land surface 83 and the annular surface 37 of the cap means 29 as illustrated.

In this manner, sufficient flame carry-over is provided between each ported area 81 by the fuel issuing out of the gap 85 therebetween and sufficient secondary air is still provided at each unported area 80 for supplying the ports 30 on adjacent sides thereof.

It was also found according to the teachings of this invention that various patterns for the ports 30 can be provided by the large land surfaces 83 and small land surfaces 84 with the land surfaces 83 being substantially the same length as the other large land surfaces 83 and each small land surface 84 being of the same annular length as the other small annular land surfaces 84 for each particular burner construction.

For example, in the embodiment of the burner construction 20 illustrated in FIGS. 1–6, there are four grooves 35 disposed between each pair of adjacent large land surfaces 83 so that there are three small land surfaces 84 disposed between each pair of adjacent large land surfaces 83.

It was found that such grooved arrangement in the annular surface 34 of the burner body 23 produces a working flame pattern for the resulting burner construction 20 when the inside diameter of the annular portion 32 of the burner body 23 is approximately 3.000 inches, the outside diameter of the annular portion 32 of the burner body 23 is approximately 3.500 inches, each U-shaped groove 35 has a depth of approximately 0.113 of an inch and a width of approximately 0.093 of an inch, the gap 85 between each large land surface 83 and the surface 37 of the cap means 29 is approximately 0.023 of an inch with substantially no gaps between the engaging small land surfaces 84 with the annular surface 37 of the cap means 29, the arc defined between each groove 35 on opposite sides of each large land area 83 is approximately 16°, and the arc between adjacent grooves 35 in each grooved area 81 is approximately 8°.

Of course, it is to be understood that such dimensions are not to be a limitation on this invention and are merely given as one example of one working embodiment of a burner construction of this invention.

In such one working embodiment of this invention, the diameter of the cylindrical portion 24' of the burner body 23 is approximately 1.260 inches while the largest diameter of the annular shoulder means 60 thereof is approximately 1.380 inches. In such working embodiment, the distance from the center line of the threaded portion 51 of the end 26 of the burner body means 23 to the surface 41 of the annular flange 40 thereof is approximately 1.275 inches.

In the burner construction 20A illustrated in FIGS. 7–12, it can be seen that the ported areas 81A thereof have six grooves 35A and, thus, five small land surfaces 84A between each pair of adjacent large land surfaces 83A with such pattern being repeated throughout the circumferential distance of the annular surface 34A except at the igniter assembly 45A thereof. Such port pattern still results in the gap 85A at each unported area 80 thereof being approximately 0.023 inches while the outside diameter of the annular portion 32A is approximately 2.200 inches and the inside diameter thereof is approximately 1.700 inches, each groove 35A having a depth of approximately 0.113 of an inch and a width of approximately 0.093 of an inch, the arc being defined between each adjacent groove 35A in each grooved section 81A thereof being approximately 12.857°, the arc defined between the grooves 35A on each side of each large land surface 83A being approximately 25.754°, the diameter defined by the chamber portion 24'A of the burner body 23A being approximately 1.010 of an inch, and the distance between the center line of the threaded portion 51A of the end wall 26A of the burner body 23A to the undersurface 41A of the flange 40A thereof being 1.275 of an inch.

Figure 14:
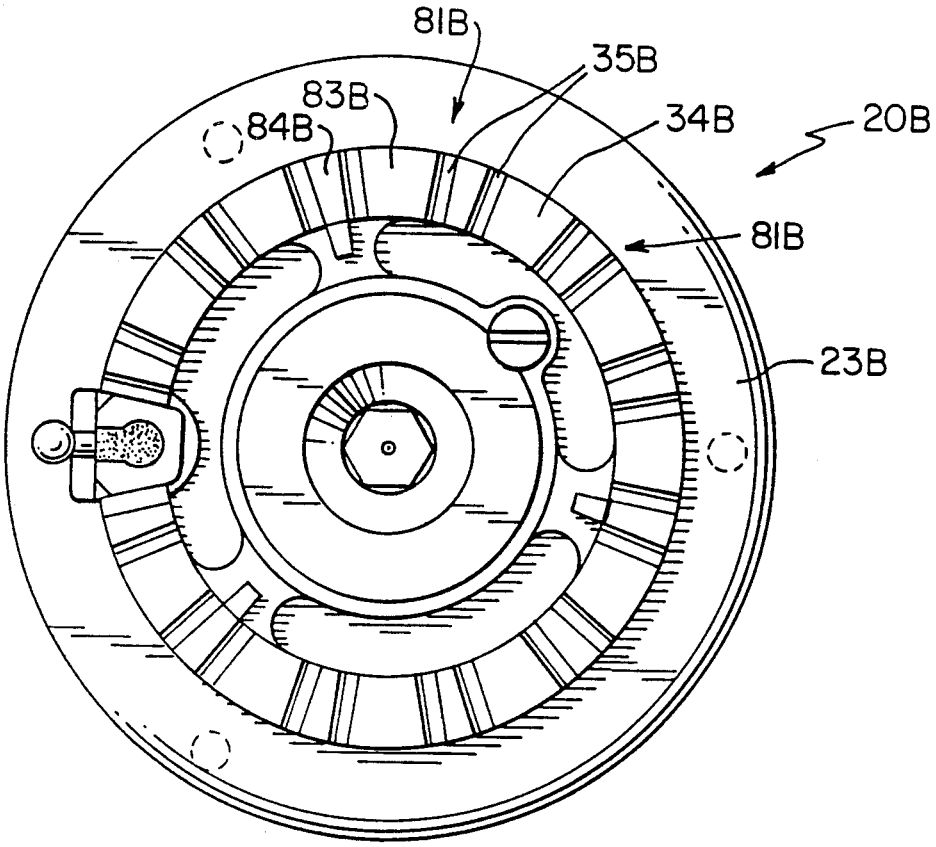
FIG. 14 is an enlarged top view of the burner body means of FIG. 13.
Figure 13:
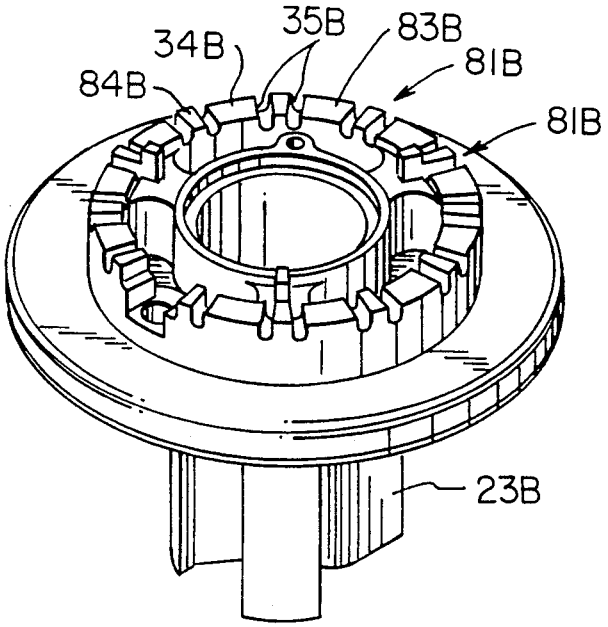
FIG. 13 is a top perspective view of another body means of another burner construction of this invention.

Another burner construction of this invention is generally indicated by the reference numeral 20B in FIGS. 13 and 14 and parts thereof similar to the burner constructions 20 and 20A previously described are indicated by like reference numerals followed by the reference letter "B".

As illustrated in FIGS. 13 and 14, only the burner body means 23B of the burner construction 20B is provided with the understanding that the remaining parts thereof are similar to the remaining parts of the burner construction 20 and 20A previously described.

Generally, the burner body 23B is substantially the same as the burner body 23A except that the grooves 35B in the annular surface 34B thereof are arranged with only two grooves 35B in each grooved portion 81B thereof so that only one small land surface 84B is disposed in each grooved area 81B while each large land surface 83B will be spaced from the end cap annular surface the same distance as the large land surfaces 83 and 83A previously described and all other dimensions of the grooves 35B being the same as the grooves 35A previously set forth.

Thus, it can be seen that it is a relatively simple method of this invention to make each burner construction 20, 20A and 20B of this invention and each burner construction is adapted to operate in a manner now to be set forth for just the burner construction 20 with the understanding that the burner construction 20A and 20B operate in a like manner.

When it is desired to utilize the burner construction 20 with the cooking apparatus 22, the burner construction 20 can be inserted in the appropriate opening 43 in the range top 42 and be sealed thereto by the annular sealing means 44, the annular flange being secured to the range top 42 in any suitable manner, such as by the spring clips 42' previously described. In any event, it can be seen that the end 26 of the burner body 23 is disposed beneath the range top structure 42 and is then interconnected to the fuel source 28 by the conduit means 57 in a conventional manner.

Thus, fuel is adapted to be directed into the passage means 49 by the control device of the conduit means 57 to issue out of the orifice means 56 into the chamber area 24' below the lower end 67 of the venturi section 61 to mix with primary air being drawn into the chamber portion 24' through the uncovered openings 59 as previously set forth whereby the primary air and fuel pass through the throat 65 of the venturi section 61 to issue out of the ports 30 of the burner construction 20 to be ignited by the electrode means 47 sparking in a conventional manner. The fuel issuing from the ports 30 adjacent the sparking electrode means 47 are first ignited and then the flame propagates around the burner construction 20 with the gaps 85 providing crossover flames to the next adjacent ported area 81 so that flames will be produced at all of the ports 30.

Such burner construction 20 has been found to provide excellent combustion with both natural gas and LP fuel while surviving on very limited secondary aeration adjacent to the ports 30 because of the secondary air provided by the ungrooved areas 80 when the burner construction has been used in a sealed installation similar to that shown in FIGS. 1 and 2. However, as previously set forth, the burner construction 20 of this invention is not to be limited to only a sealed burner arrangement as the same can be used in nonsealed burner arrangements.

However, when the burner construction 20 is utilized in a sealed burner arrangement thereof, it can be seen that constraints of dimensional height and fuel inlet approaches have been overcome to achieve an acceptable fuel injection and mixing means that exhibits a flame pattern and port velocity that is stable and predictable throughout the gas pressure variables of the environment in such applications.

As previously stated, should it be desirable to change the venturi section 61, the staking 70 can be broken away and then the venturi section 61 can be removed so that a new venturi section 61 can be disposed in place with new staking 70 provided thereover to hold the same in place.

While the venturi section 61 can be formed of any suitable material, one working embodiment thereof comprises die cast aluminum RMS-105 having the dimensions that will be appropriate for the particular burner construction utilizing the same. For example, the throat area 65 in one embodiment can be approximately 0.625 of an inch in diameter and the overall length between the ends 63 and 67 thereof is approximately 1.000 inch.

By casting either the end cap or burner body means with the U-shaped grooves for forming the ports of the resulting burner construction, good tolerances can be maintained in contrast to forming openings through a steel part whereby the part of this invention that has the U-shaped grooves 35 can be cast aluminum and the part cooperating therewith, such as the end cap 29 or the burner body means 23, can then be formed of steel or other material and close the open ends of such U-shaped grooves 35.

Thus, it can be seen that this invention provides a new burner construction and a new method of making such a burner construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. A method of making a burner construction comprising a burner body means having a chamber means therein and having opposed end means one of which is open to said chamber means and the other of which has means for interconnecting a source of fuel to said chamber means, said body means having a shoulder means extending into said chamber means, a removable cap means closing said one end means of said body means, said burner construction having port means interconnecting said chamber means to the exterior of said burner construction and through which said fuel can issue to burn externally to said burner construction, and a removable venturi section disposed in said chamber means so as to be removable therefrom through said open end means of said body means when said cap means has been removed therefrom and having opposed upper and lower open ends, said upper open end of said venturi section comprising an outwardly directed annular flange that normally rests on said shoulder means of said body means, the improvement comprising the step of holding said upper end of said venturi section against said shoulder means with holding means that engages said upper end of said venturi section, the step of holding said upper end of said venturi section against said shoulder means comprising the step of staking a portion of said body means outboard of said shoulder means over said annular flange of said venturi section to hold said upper end of said venturi section against said shoulder means whereby part of said annular flange of said venturi section is held between said shoulder means and said portion of said body means.

* * * * *